US006967044B1

(12) United States Patent
O'Brien

(10) Patent No.: US 6,967,044 B1
(45) Date of Patent: Nov. 22, 2005

(54) HEAT REFLECTION FOOTWEAR DEVICE

(75) Inventor: Peter O'Brien, Queensland (AU)

(73) Assignee: Footfridge PTY LTD, Queensland (AU)

( * ) Notice: Subject to any disclaimer, the term of this patent is extended or adjusted under 35 U.S.C. 154(b) by 0 days.

(21) Appl. No.: 09/914,783

(22) PCT Filed: Mar. 6, 2000

(86) PCT No.: PCT/AU00/00156

§ 371 (c)(1),
(2), (4) Date: Sep. 5, 2001

(87) PCT Pub. No.: WO00/53042

PCT Pub. Date: Sep. 14, 2000

(30) Foreign Application Priority Data

Mar. 5, 1999 (AU) ..... PP9055

(51) Int. Cl.[7] ..... B29D 22/00; B29D 23/00; B32B 1/08

(52) U.S. Cl. ..... 428/35.7; 428/35.2; 36/29; 36/153

(58) Field of Search ..... 428/35.7, 35.2; 36/28, 29, 30 R, 30 A, 31, 32 R, 35 R, 36 R, 36/35 B, 153

(56) References Cited

U.S. PATENT DOCUMENTS

| | | | | | |
|---|---|---|---|---|---|
| 4,123,855 | A | * | 11/1978 | Thedford | 36/44 |
| 4,658,515 | A | * | 4/1987 | Oatman | 36/44 |
| 4,813,160 | A | | 3/1989 | Kuznetz | 36/3 |
| 5,584,130 | A | | 12/1996 | Perron | 36/44 |
| 5,704,137 | A | * | 1/1998 | Dean et al. | 36/28 |
| 6,161,240 | A | * | 12/2000 | Huang | 5/710 |

FOREIGN PATENT DOCUMENTS

| | | | | |
|---|---|---|---|---|
| EP | 0 286 601 A2 | * | 12/1988 | A61L 9/01 |
| GB | 2 137 866 A | | 10/1984 | |
| SE | 7713631-5 | | 8/1982 | |

* cited by examiner

*Primary Examiner*—Michael C. Miggins
(74) *Attorney, Agent, or Firm*—Young & Thompson

(57) ABSTRACT

A heat reflection device for footwear includes a first layer of fluid-impervious material, a second layer of fluid-impervious material and a sac arranged between the first and second layers. The sac contains a heat reflective material therein. In use the device is positioned in relation to the sole of the footwear so that at least some heat conducted or converted through the sole is reflected away from the foot of the wearer of the footwear. The heat reflective material may be a mixture of heat reflective powder or particulate, thickening agent and fluid. The heat reflective powder or particulate may be one or a combination of two or more materials selected from titanium dioxide, zirconium and zinc oxide.

18 Claims, 2 Drawing Sheets

HEAT REFLECTION FOOTWEAR DEVICE

TECHNICAL FIELD OF THE INVENTION

THIS INVENTION relates to a heat deflection device for footwear and in particular but not limited to an inner sole having a sac filled with a flowable slurry containing a heat deflection material for reducing heat transfer from undersole to foot of a wearer and providing a therapeutic effect.

BACKGROUND OF THE INVENTION

Footwear in general has a sole made of rubber, leather or an synthetic or any other suitable material. The sole conducts or convects heat into the interior of the footwear. In warm climate or when it is warm in other regions the heat from the ground is transferred to the foot of a wearer through the sole. As footwear is usually shaped to enclose substantially all of the feet and is generally fairly well insulated against the environment the temperature inside the footwear quickly builds up to a level which is uncomfortable.

As human feet and hands have a relatively higher number of sweat glands per square centimeter than other parts of the body the inside of the footwear also quickly becomes damp due to sweating.

The temperature and dampness inside the footwear promote growth of algae and the footwear becomes unhygienic and usually also has an unpleasant odour. They also affect work efficiency. As much of the heat travels upward to the head and people tend not to concentrate well in this situation.

In recent years many sports such as tennis, hockey and soccer are played on synthetic surfaces, the surface temperatures of which can be as high as 60 to 70 degrees centigrade. The temperature inside the players' footwear is even higher. Long distance runners are also affected by high temperatures in footwear. Many players cannot perform to the level they are capable in this environment. Injuries through sore feet and blisters are also prominent.

An inner sole worn in footwear has been available for sometime as a source of comfort to the wearer. It is usually made of an absorbent foam material. But this inner sole does not reduces the temperature in the footwear and it does not take long for it to be saturated with sweat and thereafter the wearer continues to suffer the above discomfort.

More recently footwear with ventilation openings for cooling its interior has been introduced into the market. These openings however result in weakened zones and the strength of the footwear is greatly compromised.

OBJECT OF THE INVENTION

An object of the present invention is to alleviate or to reduce to a certain degree one or more of the present invention.

SUMMARY OF THE INVENTION

In one aspect therefor the present invention resides in a heat reflection device for footwear, the device including a first layer of fluid-impervious material, a second layer of fluid-impervious material and a sac arranged between the first and second layers, the sac containing a heat reflective material therein. In use the device is positioned in relation to the sole of the footwear so the at least some heat conducted or convected through the sole is reflected away from a foot of a wearer of the footwear.

It is preferred that the heat reflective material is a mixture having a quantity of heat reflective powder or particulate and a quantity of thickening agent. The mixture may also have a quantity of fluid so that it is flowable.

The heat reflective powder or particulate may be one or a combination of two or more materials selected from titanium dioxide, zirconium and zinc oxide. Preferably the powder or particulate are between 10 to 50% of the mixture. More preferably they are of paint grade particle size.

The thickening agent may be one or a combination of two or more selected from bentonite, attapulite and celluloses. Preferably the agent is between 30 to 90% of the mixture. The thickening agent effects in distributing the powder or particulate more evenly in the sac.

The fluid may be added to a quantity so that the mixture is of a suitable flow quality. The flow quality allows the device to massage the foot when the sac is pressed. This has a therapeutic effect on the user.

The device is generally in the shape of a foot. The sac may extend from about the heel region to about the toe region but typically extends to about the ball region of the foot.

Desirably the first and second layers are flexible and made of any suitable impervious material. Polyurethane and other plastic materials are preferred for the layers of the device. More desirably the device is reversible so that either surface of the first and second layers can be used.

The layers are generally foot shaped and can be sealingly joined around the edges by adhesive, fusion, welding or any other known technique. It is preferred that radio frequency (RF) welding is employed for the joint. Desirably the sac is also formed during joining of the edges. Where the sac is to extend to about the ball region an additional joint may extend substantially laterally in the ball region.

The device may be a sole or a removable inner sole for the footwear.

Advantageously the sole or the inner sole has spaced markings for different shoe sizes so that it can be trimmed according to a marking for desired size.

In order that the present invention can be more readily understood and be put into practical effect reference will now be made to the accompanying drawings which illustrate one preferred embodiment of the invention and wherein:

DESCRIPTION OF THE PREFERRED EMBODIMENT

Figure 1:
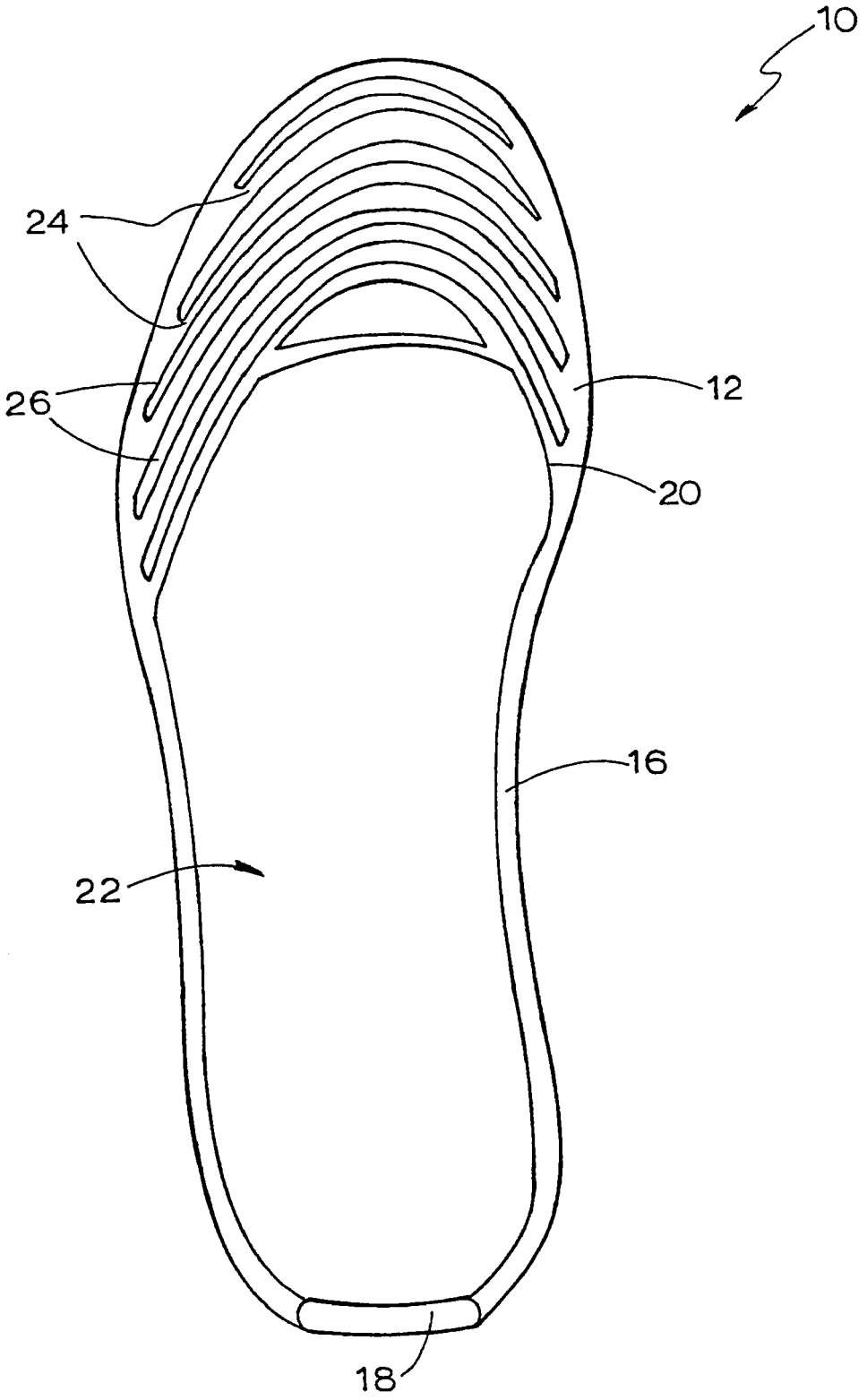
FIG. 1 is a top plan view of an inner sole according to the invention.
Figure 2:
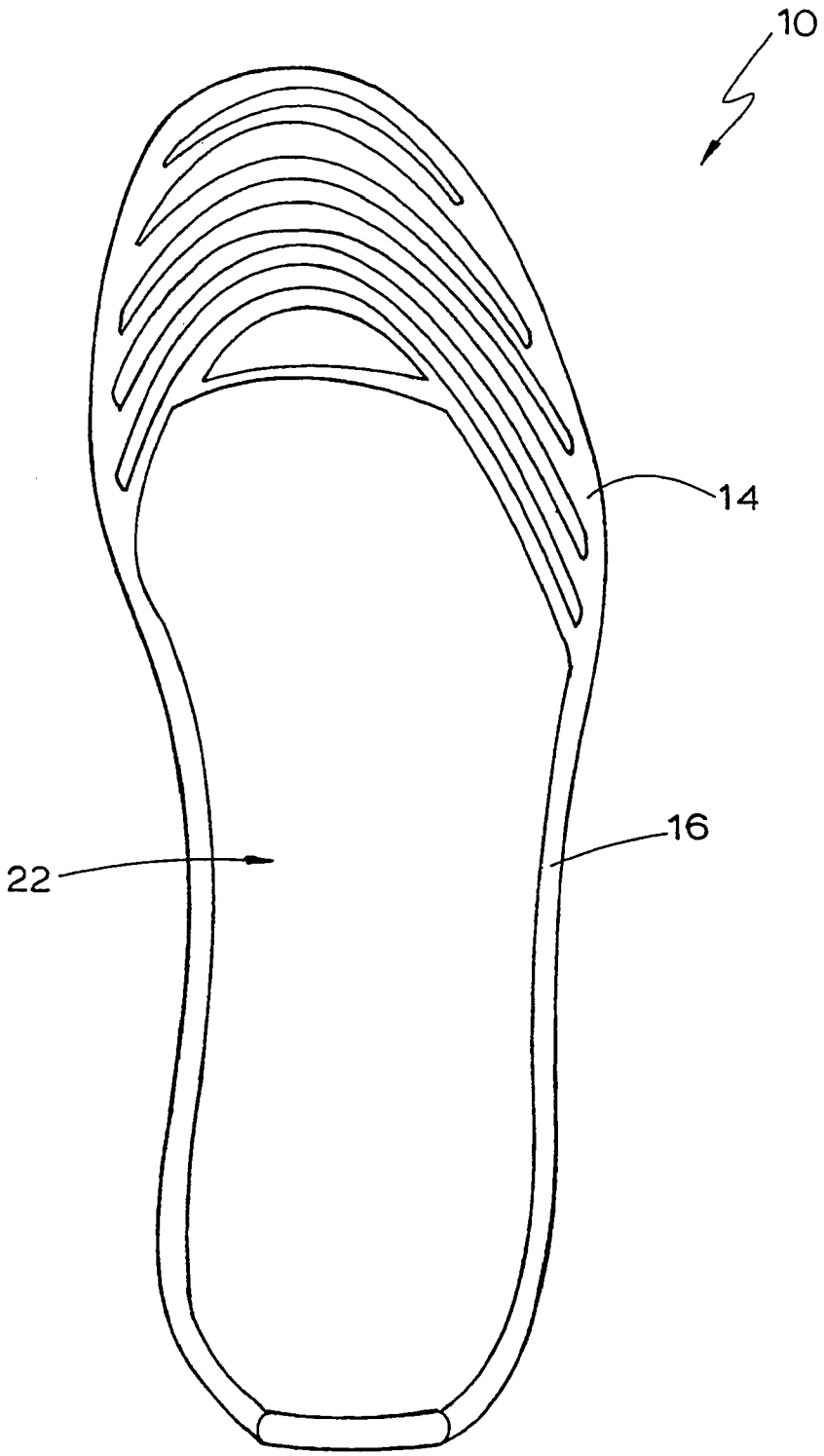
FIG. 2 is a bottom plan view of the inner sole shown in FIG. 1.

Referring to FIGS. 1 and 2 which illustrate an inner sole 10 according to the invention. As can be seen, the inner sole 10 is substantially foot shaped and has superimposed together a first layer 12 and a second layer 14 which are sealingly joined by RF welding around their edges 16 except for a small part 18 of the edges under the heel region. The purpose of the unsealed part will be described later. The layers 12 and 14 in this embodiment are made of a 0.05 mm thickness, clear polyurethane material which is impervious to water.

A further joint 20 across the ball region defines a sac 22.

The sole 10 has shoe size markings 24 forward of the sac 22 so that it can be trimmed to fit a particular shoe. In this embodiment the markings 24 are also formed by RF welding resulting in raised ribs 26 between adjacent markings 24. The raised ribs 26 are provided on the surface of layer 12 only in this embodiment. But if desired they can be provided on both layers 12 and 14.

The device 10 is reversible as either the surface of layer 12 or the surface of layer 14 can be arranged to contact a wearer's foot.

In manufacturing a mixture of 30–60% bentonite, 10–30% titanium dioxide and about 60% water is poured into the sac 22 through the unsealed part 18. Thereafter part 18 is RF welded so that the sac 22 is fluid tight. The titanium dioxide used for this mixture is paint grade sized powder.

A comparative laboratory test by measuring the temperatures on the surfaces of a known foamed rubber inner sole and the sole of the present invention as described in the above embodiment on a hot plate preheated to 60 degrees Centigrade reveals the following results:

| Temp. of hot plate (° C.) | Temp. at rubber inner sole surface (° C.) | Temp. at inner sole of invention (° C.) |
|---|---|---|
| 60.0 | 41 | 34 |

The above test was carried out when the room temperature was 23° C. and it clearly shows a substantial ly reduced temperature at the surface of the device 10.

The inventor has found that by increasing the quantity of titanium dioxide in the mixture to 46% the device 10 will become 70% reflective as compared to 43% reflective for the above embodiment.

As the mixture in the sac 22 is flowable the device 10 in use has moving high and low contact points with the foot. This provides a therapeutic massaging effect.

Whilst the above has been given by way of illustrative example of the present invention many variations and modifications thereto will be apparent to those skilled in the art without departing from the broad ambit and scope of the invention as herein set forth.

What is claimed is:

1. An inner sole device for footwear having a sole, the device comprising a first layer of fluid-impervious material, a second layer of fluid-impervious material and a sac arranged between the first and second layers, the sac containing a heat reflective material therein; the device being arranged for positioning in the footwear in a position overlying the sole of the footwear so at least some heat conducted or convected through the sole is reflected away from a foot of a wearer of the footwear, wherein said heat reflective material is titanium dioxide.

2. The device according to claim 1 wherein the heat reflective material is in a mixture having a quantity of heat reflective powder or particulate and a quantity of thickening agent.

3. The device according to claim 2 wherein the heat reflective powder or particulate is a combination of said titanium dioxide and one or more materials selected from the group consisting of zirconium and zinc oxide.

4. The device according to claim 2 wherein the powder or particulate is between 10 to 50% of the mixture.

5. The device according to claim 2 wherein the mixture having a quantity of fluid so that it is flowable.

6. The device according to claim 2 wherein the thickening agent is between 30 to 90% of the mixture.

7. The device according to claim 2 wherein the thickening agent is one or a combination of two or more materials selected from the group consisting of bentonite, attapulite and celluloses.

8. The device according to claim 5 wherein the fluid is added to a quantity so that the mixture is of a flow quality that allows the device to provide a therapeutic effect on the foot when the sac is pressed.

9. The device according to claim 1 wherein the device is formed to be generally in the shape of a foot and the sac extending from about the heel region to about the toe or ball region of the foot.

10. The device according to claim 9 wherein the first and second layers are flexible and made of an impervious material.

11. The device according to claim 10 wherein the impervious material is Polyurethane or another plastic material.

12. The device according to claim 9 wherein the device is reversible so that either surface of the first and second layers can be used.

13. The device according to claim 9 wherein the layers are sealingly joined around the edges thereof by adhesive, fusion, welding or any other known technique.

14. The device according to claim 13 wherein radio frequency (RF) welding is employed for the joining the edges.

15. The device according to claim 13 wherein the sac is also formed during joining of the edges and the sac extending to about the ball region of the foot.

16. The device according to claim 15 wherein the device having an additional joint extending substantially laterally in the ball region.

17. The device according to claim 1 wherein the device is a removable inner sole for the footwear.

18. The device according to claim 17 wherein the inner sole having spaced markings for different shoe sizes so that it can be trimmed according to a marking for a desired size.

* * * * *